US012604927B2

(12) United States Patent
Li

(10) Patent No.: US 12,604,927 B2
(45) Date of Patent: Apr. 21, 2026

(54) VAPORIZER AND ELECTRONIC VAPORIZATION DEVICE

(71) Applicant: SHENZHEN SMOORE TECHNOLOGY LIMITED, Guangdong (CN)

(72) Inventor: Xiaoping Li, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 522 days.

(21) Appl. No.: 18/076,683

(22) Filed: Dec. 7, 2022

(65) Prior Publication Data

US 2023/0172263 A1 Jun. 8, 2023

(30) Foreign Application Priority Data

Dec. 8, 2021 (CN) ..... 202111495547.X

(51) Int. Cl.

| | |
|---|---|
| ***A24F 47/00*** | (2020.01) |
| ***A24F 40/10*** | (2020.01) |
| ***A24F 40/42*** | (2020.01) |
| ***A24F 40/46*** | (2020.01) |
| ***A24F 40/485*** | (2020.01) |

(52) U.S. Cl.

CPC ..... *A24F 40/10* (2020.01); *A24F 40/42* (2020.01); *A24F 40/46* (2020.01); *A24F 40/485* (2020.01)

(58) Field of Classification Search

CPC ..... A61M 11/00; A24F 40/42; A24F 40/44; A24F 40/46; A24F 40/48; A24F 40/485

See application file for complete search history.

(56) References Cited

U.S. PATENT DOCUMENTS

| | | | | |
|---|---|---|---|---|
| 9,883,698 | B2 | 2/2018 | Zhu | |
| 2015/0181944 | A1 | 7/2015 | Li et al. | |
| 2019/0191772 | A1 | 6/2019 | Qiu | |
| 2020/0107577 | A1* | 4/2020 | Liu | A24F 40/44 |

(Continued)

FOREIGN PATENT DOCUMENTS

| | | | |
|---|---|---|---|
| CN | 106028854 | A | 10/2016 |
| CN | 206213289 | U | 6/2017 |

(Continued)

OTHER PUBLICATIONS

Chinese Patent Office, Office Action in Chinese Patent Application No. 202111495547.X (Dec. 26, 2024).

(Continued)

*Primary Examiner* — Eric Yaary

(74) *Attorney, Agent, or Firm* — Leydig, Voit & Mayer, Ltd.

(57) ABSTRACT

A vaporizer includes: a housing, an air outlet channel being formed in the housing; and a vaporization assembly assembled in the housing and having a base and a vaporization core inserted in the base, the base including a top wall facing the air outlet channel and a side wall intersecting with and connected to the top wall. A vaporization channel in communication with the air outlet channel is defined between the side wall and the vaporization core, the vaporization channel being located in an axial direction of the air outlet channel. An air inlet in communication with the vaporization channel is provided on the side wall.

19 Claims, 3 Drawing Sheets

(56) References Cited

U.S. PATENT DOCUMENTS

| | | | | |
|---|---|---|---|---|
| 2022/0248751 | A1* | 8/2022 | Hu | A24F 40/10 |
| 2022/0330615 | A1* | 10/2022 | Qiu | A24F 40/42 |
| 2022/0354174 | A1* | 11/2022 | Liu | A24F 40/46 |

FOREIGN PATENT DOCUMENTS

| | | | |
|---|---|---|---|
| CN | 107581660 | A | 1/2018 |
| CN | 107788578 | A | 3/2018 |
| CN | 108720082 | A | 11/2018 |
| CN | 111011932 | A | 4/2020 |
| CN | 210611013 | U | 5/2020 |
| CN | 210747262 | U | 6/2020 |
| CN | 211211433 | U | 8/2020 |
| CN | 112586806 | A | 4/2021 |
| CN | 113068863 | A | 7/2021 |
| CN | 113142667 | A | 7/2021 |
| CN | 216875006 | U | 7/2022 |
| CN | 216875007 | U | 7/2022 |
| WO | 2014023171 | A1 | 2/2014 |
| WO | 2015000183 | A1 | 1/2015 |
| WO | 2015018026 | A1 | 2/2015 |
| WO | 2015139394 | A1 | 9/2015 |
| WO | 2020259692 | A1 | 12/2020 |

OTHER PUBLICATIONS

Chinese Patent Office, Office Action in Chinese Patent Application No. 202111493461.3 (Dec. 25, 2024).
European Patent Office, Search Report in European Patent Application No. 22211675.8 (May 8, 2023).
Chinese Patent Office, Office Action in Chinese Patent Application No. 202111495547.X (Jul. 1, 2025).

* cited by examiner

VAPORIZER AND ELECTRONIC VAPORIZATION DEVICE

CROSS-REFERENCE TO PRIOR APPLICATION

Priority is claimed to Chinese Patent Application No. 202111495547.X, filed on Dec. 8, 2021, the entire disclosure of which is hereby incorporated by reference herein.

FIELD

The present invention relates to the field of vaporization technologies, and in particular, to a vaporizer and an electronic vaporization device.

BACKGROUND

Aerosol is a colloidal dispersion system formed by small solid or liquid particles dispersed and suspended in a gas medium. Since the aerosol is absorbable by the human body through the respiratory system, a novel alternative absorption manner is provided for the user. For example, vaporization devices that can generate aerosols by baking and heating herbal or paste-like aerosol-forming substrates are applied to different fields, to deliver inhalable aerosols for the users, leading to replacement of conventional product forms and absorption manners.

Generally, an electronic vaporization device heats and vaporizes the aerosol-forming substrate through a vaporizer. However, an air inlet of the vaporizer is provided on a bottom surface, condensate may be formed when the aerosol inside the vaporizer flows back, and the condensate is likely to overflow from the air inlet under the action of its own gravity, resulting in corrosion damage to electronic components such as a cell at the bottom of the vaporizer. In addition, the internal airway of a conventional vaporizer is relatively long, and the inner wall of the airway provides a relatively long bearing surface for aerosol that flows back, which is likely to result in formation of more condensate. Therefore, the conventional vaporizer is prone to formation of a large amount of condensate that overflows.

SUMMARY

In an embodiment, the present invention provides a vaporizer, comprising: a housing, an air outlet channel being formed in the housing; and a vaporization assembly assembled in the housing and comprising a base and a vaporization core inserted in the base, the base comprising a top wall facing the air outlet channel and a side wall intersecting with and connected to the top wall, wherein a vaporization channel in communication with the air outlet channel is defined between the side wall and the vaporization core, the vaporization channel being located in an axial direction of the air outlet channel, and wherein an air inlet in communication with the vaporization channel is provided on the side wall.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
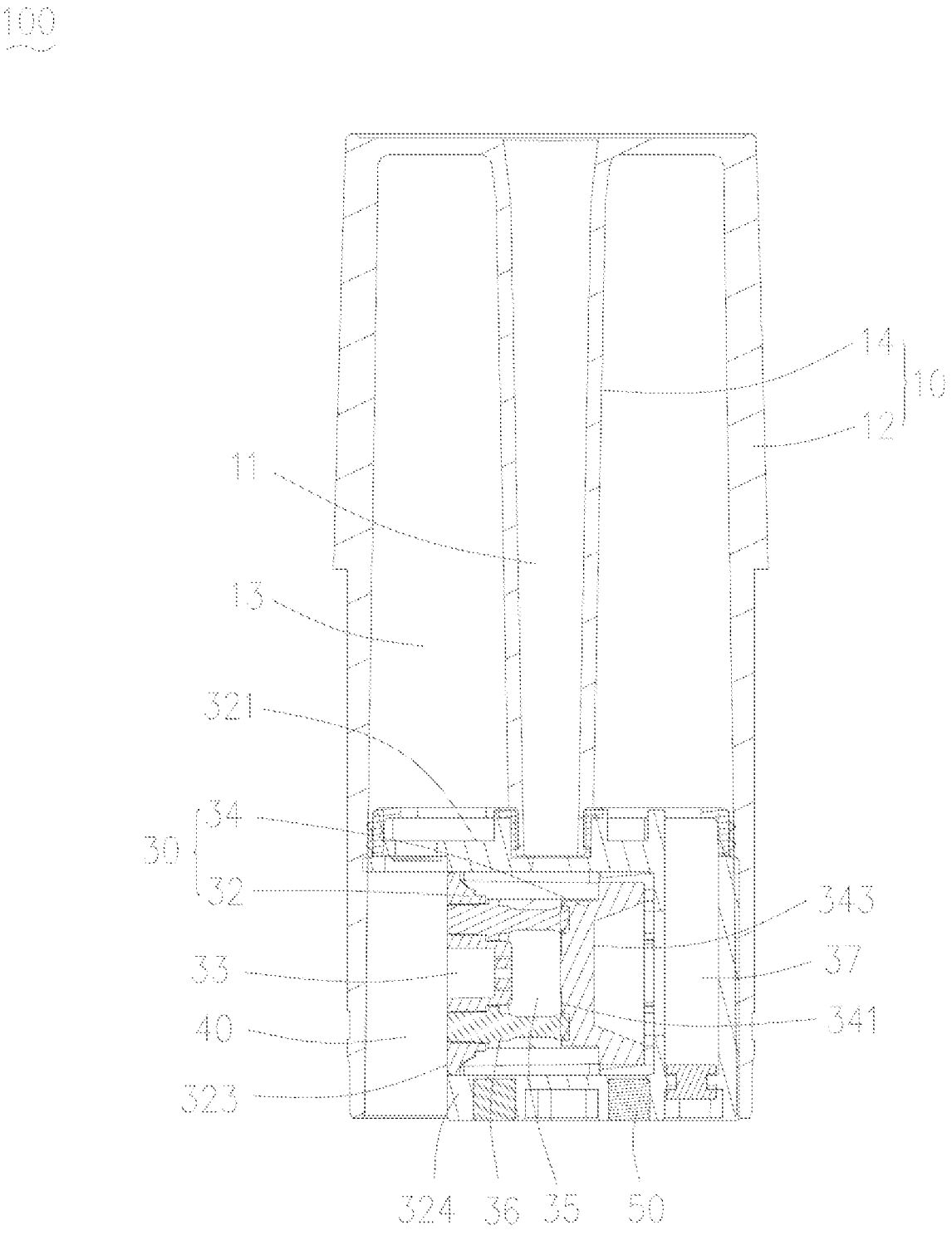
FIG. 1 is a schematic structural diagram of a vaporizer according to an embodiment of the present invention.

In an embodiment, the present invention provides a vaporizer and an electronic vaporization device to resolve the problem a conventional vaporizer is prone to formation of a large amount of condensate that overflows.

A vaporizer is provided, including:

- a housing, where an air outlet channel is formed in the housing; and
- a vaporization assembly, assembled in the housing and including a base and a vaporization core inserted in the base, where the base includes a top wall facing the air outlet channel and a side wall intersecting with and connected to the top wall, where
- a vaporization channel in communication with the air outlet channel is defined between the side wall and the vaporization core, the vaporization channel is located in an axial direction of the air outlet channel, and an air inlet in communication with the vaporization channel is provided on the side wall.

In the foregoing vaporizer, the vaporization channel is defined between the side wall of the base and the vaporization core, and the vaporization channel is located in the axial direction of the air outlet channel, so that external air directly enters into the vaporization channel through the air inlet on the side wall and then can enter into the air outlet channel in the axial direction of the air outlet channel, which is equivalent to that an airflow pathway inside the vaporizer is L-shaped, and the pathway is relatively simple and short, so that the airflow pathway is prevented from generating a large amount of condensate after absorbing a large amount of aerosol because of being excessively long, thereby reducing the formation of condensate. In addition, the air inlet of the vaporizer is located on the side wall of the base rather than a bottom wall of the base, so that condensate generated in an internal airway may not directly flow out through the air inlet, thereby preventing the overflow of the condensate.

In this way, the vaporizer provided in this application not only can prevent condensate from leaking through the air inlet, but also can prevent generation of excessive condensate, thereby reducing the risk of the overflow of the condensate and reducing the amount of condensate leaking from the vaporizer. In addition, the airflow pathway inside the vaporizer provided in this application is relatively short, so that an external airflow can quickly enter into the vaporization channel to carry the vaporized aerosol, thereby improving the vaporization amount of the aerosol-forming substrate.

In an embodiment, the vaporization core includes a vaporization surface parallel to the axial direction of the air outlet channel, the vaporization surface is relatively spaced apart from the side wall, and the vaporization channel is defined between the vaporization surface and the side wall.

In an embodiment, the air inlet directly faces the vaporization surface.

In an embodiment, the vaporization assembly further includes an electrode, one end of the electrode is electrically connected to a heating member on the vaporization core, and the other end of the electrode penetrates through the side wall and is relatively exposed on an outer surface of the side wall.

In an embodiment, the electrode penetrates through the side wall in a direction intersecting with the axial direction of the air outlet channel.

In an embodiment, a docking cavity is defined between the housing and the outer surface of the side wall, where the docking cavity is configured to accommodate a docking convex portion on the cell base.

In an embodiment, the base includes a base body and a holder, the vaporization core and the holder are both inserted in the base body, one end of the holder abuts against the vaporization core, the other end of the holder is the side wall and is provided with the air inlet, and the electrode fixedly penetrates through the end of the holder provided with the air inlet.

In an embodiment, the vaporization core includes a liquid absorbing surface facing away from the vaporization surface, a liquid storage cavity is formed inside the housing, a liquid inlet channel in communication with the liquid storage cavity is provided on the base body, and the liquid absorbing surface is in fluid communication with the liquid inlet channel.

In an embodiment, the liquid storage cavity is arranged around a periphery of the air outlet channel, and the liquid inlet channel is located on a surface of the vaporization core facing away from the air inlet and extends in a direction parallel to the axial direction of the air outlet channel.

In an embodiment, the vaporizer further includes a magnetic member, the base includes a bottom wall arranged opposite to the top wall, and the magnetic member is assembled on the bottom wall.

An electronic vaporization device is provided, including the foregoing vaporizer.

REFERENCE NUMERALS

100—Vaporizer; 10—Housing; 11—Air outlet channel; 12—Outer housing; 13—Liquid storage cavity; 14—Inner housing; 30—Vaporization assembly; 32—Base; 321—Top wall; 323—Side wall; 324—Bottom wall; 325—Base body; 326—Air passing opening; 327—Holder; 33—Air inlet; 34—Vaporization core; 35—Vaporization channel; 341—Vaporization surface; 343—Liquid absorbing surface; 36—Electrode; 37—Liquid inlet channel; 40—Docking cavity; 50—Magnetic member; 200—Electronic vaporization device; 210—Cell base; and 211—Docking convex portion.

To make the foregoing objects, features, and advantages of the present invention more comprehensible, detailed description is made to specific implementations of the present invention below with reference to the accompanying drawings. In the following description, many specific details are described to give a full understanding of the present invention. However, the present invention may be implemented in many other manners different from those described herein. A person skilled in the art may make similar improvements without departing from the connotation of the present invention. Therefore, the present invention is not limited to the specific embodiments disclosed below.

In the description of the present invention, it should be understood that, orientation or position relationships indicated by terms such as "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", and "circumferential" are orientation or position relationship shown based on the accompanying drawings, and are merely used for describing the present invention and simplifying the description, rather than indicating or implying that the mentioned apparatus or element should have a particular orientation or be constructed and operated in a particular orientation, and therefore, should not be construed as a limitation to the present invention.

In addition, the terms "first" and "second" are used for descriptive purposes only and are not to be construed as indicating or implying relative importance or implicitly indicating the number of technical features indicated. Therefore, features defining "first" and "second" can explicitly or implicitly include at least one of the features. In the description of the present invention, unless otherwise explicitly defined, "a plurality of" means at least two, for example, two, three, and the like.

In the present invention, unless otherwise explicitly specified and defined, terms such as "mounted", "connected", "connection", and "fixed" should be understood in a broad sense. For example, the connection may be a fixed connection, a detachable connection, or an integral connection; or the connection may be a mechanical connection or an electrical connection; or the connection may be a direct connection, an indirect connection through an intermediate medium, or internal communication between two elements or mutual action relationship between two elements, unless otherwise explicitly specified. A person of ordinary skill in the art may understand the specific meanings of the foregoing terms in the present invention according to specific situations.

In the present invention, unless otherwise clearly specified and limited, that a first feature is "above" or "below" a second feature may be that the first and the second features are in contact with each other directly, or the first and the second features are in contact with each other indirectly by using an intermediate medium. In addition, that the first feature is "above", "over", or "on" the second feature may indicate that the first feature is directly above or obliquely above the second feature, or may merely indicate that the horizontal position of the first feature is higher than that of the second feature. That the first feature is "below", "under", and "beneath" the second feature may be that the first feature is right below the second feature or at an inclined bottom of the second feature, or may merely indicate that the horizontal position of the first feature is lower than that of the second feature.

It should be noted that, when an element is referred to as "being fixed to" or "being arranged on" another element, the element may be directly on the another element, or an intermediate element may be present. When an element is considered to be "connected to" another element, the element may be directly connected to the another element, or an intermediate element may also be present. The terms "vertical", "horizontal", "upper", "lower", "left", "right", and similar expressions used in this specification are only for purposes of illustration but are not intended to indicate a unique implementation.

FIG. 1 is a schematic structural diagram of a vaporizer according to an embodiment of the present invention. Referring to FIG. 1, an embodiment of the present invention provides a vaporizer 100, configured to heat and vaporize an aerosol-forming substrate to form aerosol delivered to a user.

The vaporizer 100 includes a housing 10 and a vaporization assembly 30. An air outlet channel 11 is formed in the housing 10. The vaporization assembly 30 is assembled in the housing 10 and includes a base 32 and a vaporization core 34 inserted in the base 32.

The base 32 includes a top wall 321 facing the air outlet channel 11 and a side wall 323 intersecting with and connected to the top wall 321. A vaporization channel 35 in communication with the air outlet channel 11 is defined between the side wall 323 of the base 32 and the vaporization core 34, the vaporization channel 35 is located in an axial direction of the air outlet channel 11, and an air inlet 33 in communication with the vaporization channel 35 is provided on the side wall 323. During operation of the vaporizer 100, an aerosol-forming substrate is adsorbed in the vaporization core 34, the aerosol-forming substrate is vaporized into aerosol and enters into the vaporization channel 35 after the vaporization core 34 is heated, and then an airflow flowing through the vaporization channel 35 from the air inlet 33 carries the aerosol to flow out of the air outlet channel 11, to deliver the vaporized aerosol to the user.

In this way, the vaporization channel 35 is defined between the side wall 323 of the base 32 and the vaporization core 34, and the vaporization channel 35 is located in the axial direction of the air outlet channel 11, so that external air directly enters into the vaporization channel 35 through the air inlet 33 on the side wall 323 and then can enter into the air outlet channel 11 in the axial direction of the air outlet channel 11, which is equivalent to that an airflow pathway inside the vaporizer 100 is L-shaped, and the pathway is relatively simple and short, so that the airflow pathway is prevented from generating a large amount of condensate after absorbing a large amount of aerosol because of being excessively long, thereby reducing the formation of condensate. In addition, the air inlet 33 of the vaporizer 100 is located on the side wall 323 of the base 32 rather than a bottom wall 324 of the base 32, so that condensate generated in an internal airway may not directly flow out through the air inlet 33 on a side surface, thereby preventing the overflow of the condensate.

In this way, the vaporizer 100 provided in this application not only can prevent condensate from leaking through the air inlet 33, but also can prevent generation of excessive condensate, thereby reducing the risk of the overflow of the condensate, and reducing the amount of condensate leaking from the vaporizer 100. In addition, the airflow pathway inside the vaporizer 100 provided in this application is relatively short, so that an external airflow can quickly enter into the vaporization channel 35 to carry the vaporized aerosol, thereby improving the vaporization amount of the aerosol-forming substrate.

Further, the vaporization core 34 includes a vaporization surface 341 parallel to the axial direction of the air outlet channel 11, that is, the vaporization core 34 is laterally arranged, and the vaporization surface 341 is relatively spaced apart from the side wall 323, and the vaporization channel 35 is defined between the vaporization surface 341 and the side wall 323, so that the formed vaporization channel 35 is linear with a simple structure and a short pathway, thereby reducing the formation of condensate while improving the vaporization amount of the aerosol-forming substrate.

Specifically, the air inlet 33 provided on the side wall 323 directly faces the vaporization surface 341, so that the air inlet 33 is in direct communication with the vaporization channel 35 between the side wall 323 and the vaporization surface 341, and air flowing in an axial direction of the air inlet 33 can directly enter into the vaporization channel 35 without making a turn before entering the vaporization channel 35, thereby shortening the airflow pathway.

In some embodiments, the vaporization assembly 30 further includes an electrode 36. The vaporization core 34 further includes a heating member. One end of the electrode 36 is electrically connected to the heating member, and the other end of the electrode 36 penetrates through the side wall 323 and is relatively exposed on an outer surface of the side wall 323. It is equivalent to that, not only the air inlet 33 is provided on the side wall 323 of the base 32, but also the electrode 36 penetrates through the side wall 323, so that the electrode 36 is fixedly mounted through the side wall 323. In addition, the electrode 36 is relatively exposed on the outer surface of the side wall 323 to be used as a docking end that is of the heating member on the vaporization core 34 and that is electrically connected to a cell base 210, so that the docking end has a specific area. In this way, the electrical contact between the electrode 36 on the side wall 323 and the cell base 210 can be ensured even if there is a slight relative displacement between the vaporizer 100 and the cell base 210 in a mounting direction, thereby improving the stability of power supply.

Further, the electrode 36 penetrates through the side wall 323 in a direction intersecting with the axial direction of the air outlet channel 11, that is, the electrode 36 is transversely arranged. In this way, after the vaporizer 100 and the cell base 210 are vertically mounted in a docked manner, the electrode 36 transversely arranged may still be in electrical contact with the cell base 210 on the outer surface of the side wall 323 in a case that the cell base 210 is slightly misaligned with the vaporizer 100 in the mounting direction.

In some embodiments, a docking cavity 40 is defined between the housing 10 and the outer surface of the side wall 323, where the docking cavity 40 is configured to accommodate a docking convex portion 211 on the cell base 210. During assembly of the vaporizer 100 and the cell base 210, the docking convex portion 211 on the cell base 210 is inserted into an accommodation cavity, so that the electrode 36 relatively exposed on the outer surface of the side wall 323 can come into electrical contact with a docking terminal on the docking convex portion 211 through the docking cavity 40, thereby achieving the electrical connection between the heating member on the vaporization core 34 and the cell base 210. In addition, the docking cavity 40 accommodates the docking convex portion 211 to limit the docking convex portion 211, so that the docking convex portion 211 is prevented from being separated from the side wall 323, thereby ensuring that the electrode 36 is electrically connected to the cell base 210 effectively after the docking convex portion 211 comes in contact with the side wall 323, and further improving the reliability of power supply.

Specifically, the docking cavity 40 limits the docking convex portion 211 in a first direction perpendicular to the air outlet channel 11 and a second direction perpendicular to the air outlet channel 11 and the first direction, to prevent the docking convex portion 211 from being displaced in the thickness and width directions of the vaporizer 100 and improve the reliability of contact between the docking convex portion 211 and the side wall 323, thereby improving the user experience.

Figure 2:
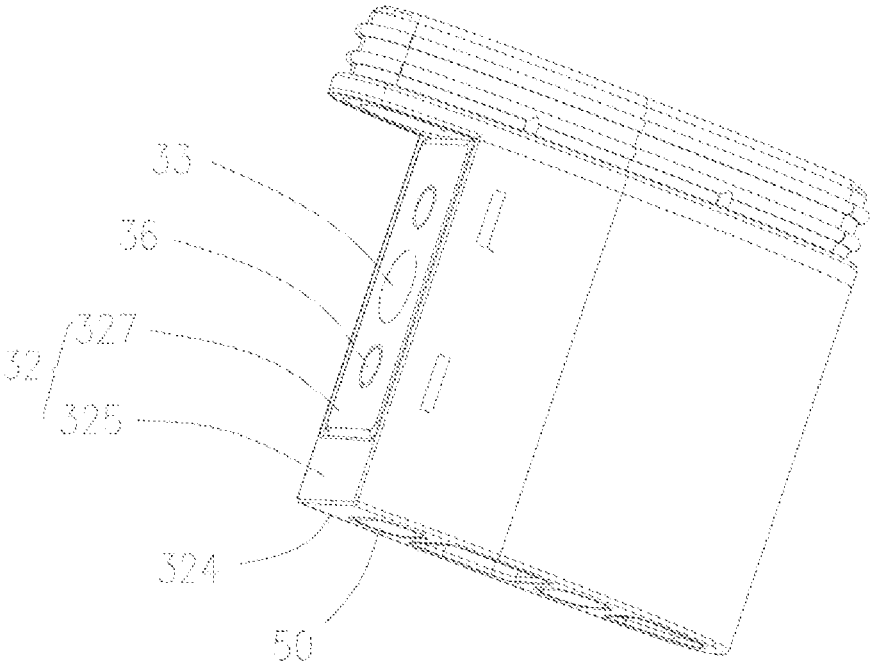
FIG. 2 is a schematic structural diagram of a vaporization assembly of the vaporizer shown in FIG. 1.
Figure 3:
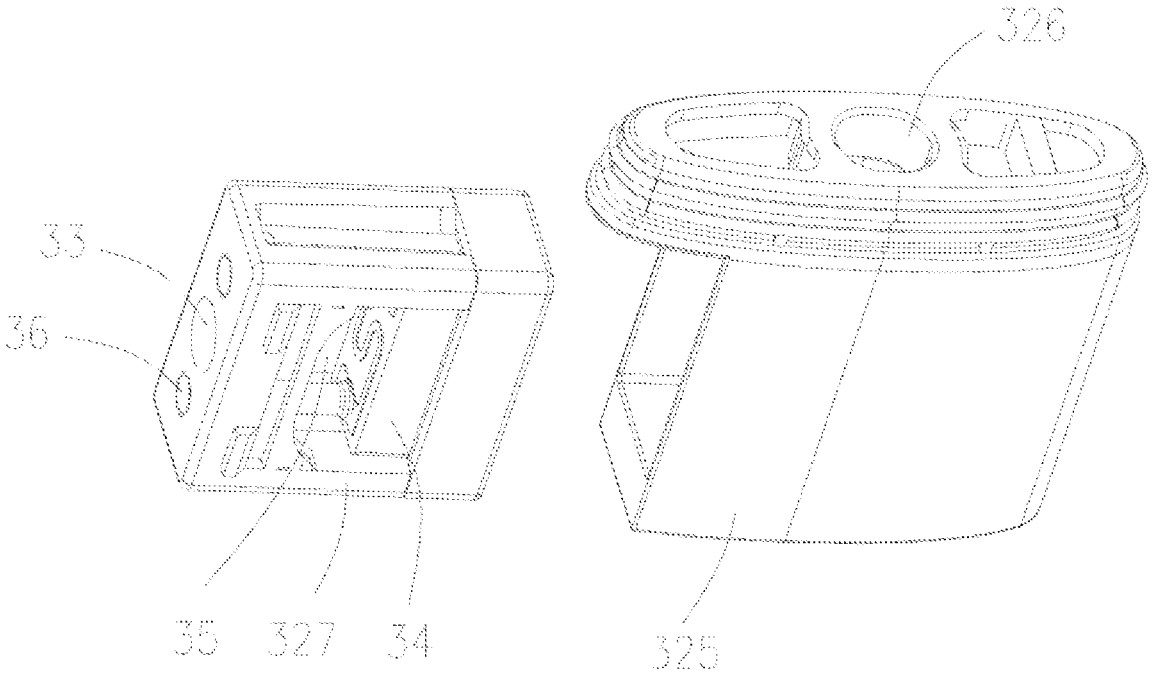
FIG. 3 is a schematic exploded view of the vaporization assembly shown in FIG. 2.

FIG. 2 is a schematic structural diagram of a vaporization assembly of the vaporizer shown in FIG. 1. FIG. 3 is a schematic exploded view of the vaporization assembly shown in FIG. 2.

Referring to FIG. 2 and FIG. 3, in some embodiments, the base 32 includes a base body 325 and a holder 327. The vaporization core 34 and the holder 327 are both inserted in the base body 325, one end of the holder 327 abuts against the vaporization core 34, the other end of the holder 327 is the side wall 323 and is provided with the air inlet 33, and the electrode 36 fixedly penetrates through the end of the holder 327 provided with the air inlet 33. For the ease of assembling the vaporization core 34 and forming the vaporization channel 35, the base 32 is divided into the base body 325 and the holder 327, the vaporization core 34 is inserted in the base body 325, and the holder 327 is further sleeved on the base body 325 and abuts against the vaporization core 34, to fix the vaporization core 34. In addition, an end of the holder 327 far away from the vaporization core 34 is constructed as the side wall 323 and provided with the air inlet 33, to form the vaporization channel 35 between the holder 327 and the vaporization core 34. Moreover, a cell is further fixedly assembled on the base 32 through the holder 327.

Further, an air passing opening 326 in communication with the vaporization channel 35 and the air outlet channel 11 is provided on the base body 325, to allow an airflow to flow from the vaporization channel 35 to the air outlet channel 11. In addition, a through groove in communication with the vaporization channel 35 and the air passing opening 326 is formed on the holder 327, so that the electrode 36 can be assembled through the holder 327 without affecting the communication between the vaporization channel 35 between the holder 327 and the vaporization core 34 and the air outlet channel 11.

Referring to FIG. 1, specifically, the vaporization core 34 includes a liquid absorbing surface 343 facing away from the vaporization surface 341, a liquid storage cavity 13 is formed inside the housing 10, a liquid inlet channel 37 in communication with the liquid storage cavity 13 is provided on the base body 325, and the liquid absorbing surface 343 is in fluid communication with the liquid inlet channel 37. It is equivalent to that, the liquid inlet channel 37 is provided on the base body 325, and an aerosol-forming substrate in the liquid storage cavity 13 is guided to the liquid absorbing surface 343 on the vaporization core 34, so that the aerosol-forming substrate is adsorbed and stored inside the vaporization core 34.

Optionally, the liquid storage cavity 13 is arranged around a periphery of the air outlet channel 11, and the liquid inlet channel 37 is located on a surface of the vaporization core 34 facing away from the air inlet 33 and extends in a direction parallel to the axial direction of the air outlet channel 11. It is equivalent to that, one side of the base 32 is provided with the air inlet 33, and the other side of the base 32 is provided with the liquid inlet channel 37, to guide the aerosol-forming substrate in the annular liquid storage cavity 13 to the vaporization core 34 through the liquid inlet channel 37 on one side far away from the air inlet 33. In addition, when the vaporization core 34 is normally held for use, the liquid inlet channel 37 extends in a vertical direction, and the aerosol-forming substrate in the liquid storage cavity 13 is allowed to come into contact with the liquid absorbing surface 343 of the vaporization core 34 after flowing toward the liquid inlet channel 37.

In some embodiments, the housing 10 includes an outer housing 12 and an inner housing 14 inserted in the outer housing 12. The inner housing 14 includes the air outlet channel 11, and the liquid storage cavity 13 is defined between the inner housing 14 and the outer housing. The outer housing 12 further includes an accommodation cavity located on the same side of the liquid storage cavity 13 and the air outlet channel 11, and the vaporization assembly 30 is arranged in the accommodation cavity and seals the liquid storage cavity 13. The vaporization assembly 30 is inserted in the outer housing 12, an air outlet of the vaporization assembly 30 is in communication with the air outlet channel 11 on the inner housing 14, and in addition, the vaporization assembly 30 blocks an opening of the liquid storage cavity 13, to complete the assembly of the vaporization assembly 30 and the housing 10.

In some embodiments, the vaporizer 100 further includes a magnetic member 50, the base 32 includes a bottom wall 324 arranged opposite to the top wall 321, and the magnetic member 50 is assembled on the bottom wall 324, so that the vaporizer 100 can be attracted and fixed to the cell base 210 through the magnetic member 50, thereby improving the mounting reliability between the vaporizer 100 and the cell base 210.

Figure 4:
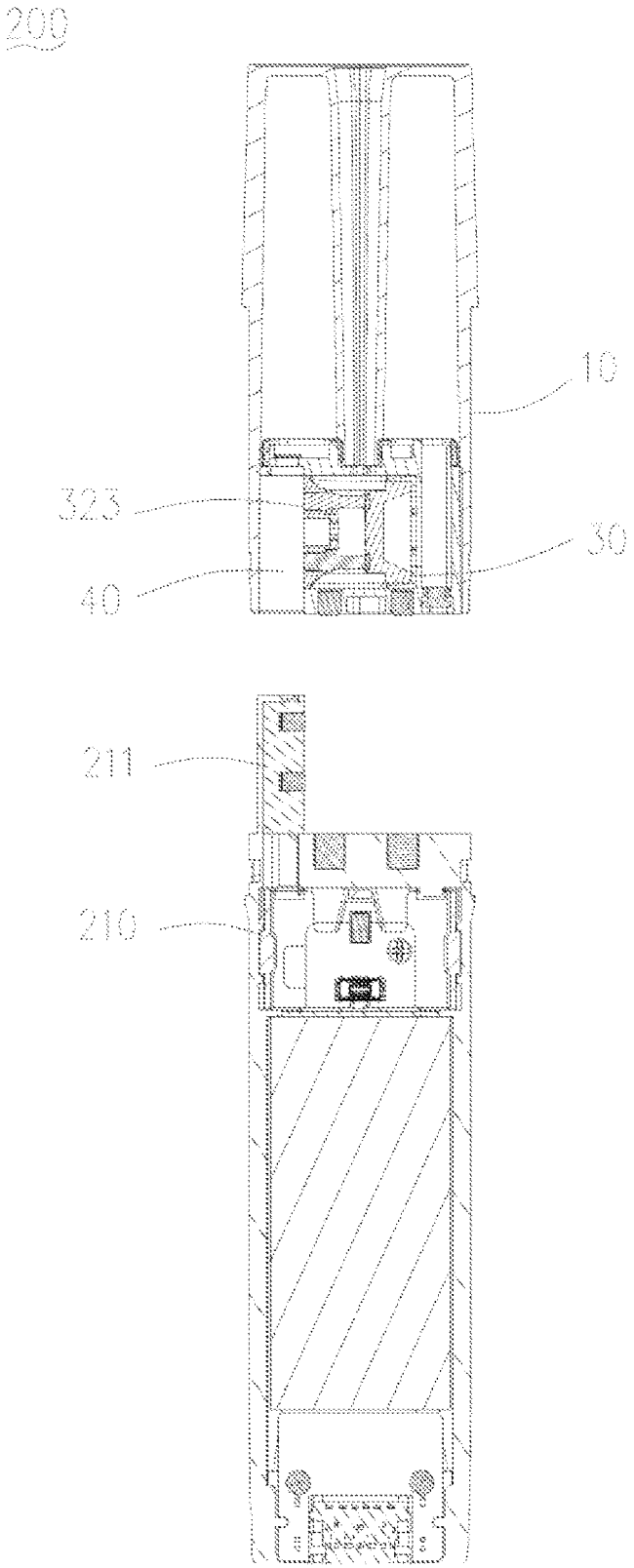
FIG. 4 is a schematic structural diagram of an electronic vaporization device according to an embodiment of the present invention.

FIG. 4 is a schematic structural diagram of an electronic vaporization device according to an embodiment of the present invention. Referring to FIG. 4, an embodiment of the present invention further provides an electronic vaporization device 200 including the vaporizer 100. The vaporizer 100 includes a housing 10 and a vaporization assembly 30. An air outlet channel 11 is formed in the housing 10. The vaporization assembly 30 is assembled in the housing 10 and includes a base 32 and a vaporization core 34 inserted in the base 32. The base 32 includes a top wall 321 facing the air outlet channel 11 and a side wall 323 intersecting with and connected to the top wall 321. A vaporization channel 35 in communication with the air outlet channel 11 is defined between the side wall 323 of the base 32 and the vaporization core 34, the vaporization channel 35 is located in an axial direction of the air outlet channel 11, and an air inlet 33 in communication with the vaporization channel 35 is provided on the side wall 323. In this way, the vaporization channel 35 is defined between the side wall 323 of the base 32 and the vaporization core 34, and the vaporization channel 35 is located in the axial direction of the air outlet channel 11, so that external air directly enters into the vaporization channel 35 through the air inlet 33 on the side wall 323 and then can enter into the air outlet channel 11 in the axial direction of the air outlet channel 11, which is equivalent to that an airflow pathway inside the vaporizer 100 is L-shaped, and the pathway is relatively simple and short, so that the airflow pathway is prevented from generating a large amount of condensate after absorbing a large amount of aerosol because of being excessively long, thereby reducing the formation of condensate.

In addition, the air inlet 33 of the vaporizer 100 is located on the side wall 323 of the base 32 rather than a bottom wall 324 of the base 32, so that condensate generated in an internal airway may not directly flow out through the air inlet 33 on a side surface, thereby preventing the overflow of the condensate. Therefore, the vaporizer 100 provided in this application not only can prevent condensate from leaking through the air inlet 33, but also can prevent generation of excessive condensate, thereby reducing the risk of condensate leakage, and reducing the amount of condensate leaking from the vaporizer 100. In addition, the airflow pathway inside the vaporizer 100 provided in this application is relatively short, so that an external airflow can quickly enter into the vaporization channel 35 to carry the vaporized aerosol, thereby improving the vaporization amount of the aerosol-forming substrate.

In some embodiments, the electronic vaporization device 200 further includes a cell base 210. The cell base 210 includes a main body and a docking convex portion 211 protruding relative to the main body. The docking convex portion 211 includes a docking terminal, and the docking terminal is allowed to come into electrical contact with the electrode 36 when the docking convex portion 211 is docked with the side wall 323, to achieve the electrical connection between the vaporizer 100 and the cell base 210.

Further, the docking cavity 40 is formed in the vaporizer 100, and the docking convex portion 211 is inserted in the docking cavity 40. In this way, the docking cavity 40 accommodates the docking convex portion 211 to limit and fix the docking convex portion 211, so that the docking convex portion 211 is prevented from being separated from the side wall 323, thereby ensuring that the electrode 36 is electrically connected to the cell base 210 effectively after the docking convex portion 211 comes in contact with the side wall 323, and further improving the reliability of power supply.

Specifically, the docking cavity 40 limits the docking convex portion 211 in a first direction perpendicular to the air outlet channel 11 and a second direction perpendicular to the air outlet channel 11 and the first direction, to prevent the docking convex portion 211 from being displaced in the thickness and width directions of the vaporizer 100 and improve the reliability of contact between the docking convex portion 211 and the side wall 323, thereby improving the user experience.

In some embodiments, an air inlet channel communicating between the outside and the air inlet 33 is formed inside the docking convex portion 211, the external airflow passes through the air inlet channel in the docking convex portion 211 and then enters into the air inlet 33 on the side wall 323, and finally flows inside the vaporizer 100. In this way, air is supplied to the air inlet 33 through the docking convex portion 211, to achieve air intake from a side of the vaporizer 100. In addition, the air inlet channel in the docking convex portion 211 is located on a side of the air inlet 33 rather than being located at the bottom of the air inlet 33. When a part of the aerosol in the vaporizer 100 flows back to form condensate, the condensate cannot easily enter into the docking convex portion 211 on the side through the air inlet 33, which can effectively prevent electronic components inside the cell base 210 from corrosion damage caused by the condensate, thereby prolonging the service life of the electronic vaporization device 200.

The technical features in the foregoing embodiments may be randomly combined. For concise description, not all possible combinations of the technical features in the embodiments are described. However, provided that combinations of the technical features do not conflict with each other, the combinations of the technical features are considered as falling within the scope described in this specification.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer, comprising:

a housing, an air outlet channel being formed in the housing; and a vaporization assembly assembled in the housing and comprising a base and a vaporization core inserted in the base, the base comprising a top wall facing the air outlet channel and a side wall intersecting with and connected to the top wall, wherein a vaporization channel in communication with the air outlet channel is defined between the side wall and the vaporization core, the vaporization channel being located in an axial direction of the air outlet channel, wherein the vaporization core comprises a vaporization surface parallel to the axial direction of the air outlet channel, and wherein an air inlet in communication with the vaporization channel is provided on the side wall of the base of the housing so as to directly face the vaporization surface of the vaporization core.

2. The vaporizer of claim 1, wherein the vaporization surface is spaced apart from the side wall, and wherein the vaporization channel is defined between the vaporization surface and the side wall.

3. The vaporizer of claim 2, wherein the vaporization assembly further comprises an electrode, the vaporization core further comprises a heating member, one end of the electrode is electrically connected to the heating member, and another end of the electrode penetrates through the side wall and is relatively exposed on an outer surface of the side wall.

4. The vaporizer of claim 3, wherein the electrode penetrates through the side wall in a direction intersecting with the axial direction of the air outlet channel.

5. The vaporizer of claim 3, wherein a docking cavity is defined between the housing and the outer surface of the side wall, and wherein the docking cavity is configured to accommodate a docking convex portion on a cell base thereof.

6. The vaporizer of claim 3, wherein the base comprises a base body and a holder, wherein the vaporization core and the holder are both inserted in the base body, wherein one end of the holder abuts against the vaporization core and another end of the holder comprises the side wall and is provided with the air inlet, and wherein the electrode fixedly penetrates through the end of the holder provided with the air inlet.

7. The vaporizer of claim 6, wherein the vaporization core comprises a liquid absorbing surface facing away from the vaporization surface, wherein a liquid storage cavity is formed inside the housing, wherein a liquid inlet channel in communication with the liquid storage cavity is provided on the base body, and wherein the liquid absorbing surface is in fluid communication with the liquid inlet channel.

8. The vaporizer of claim 7, wherein the liquid storage cavity is arranged around a periphery of the air outlet channel, and wherein the liquid inlet channel is located on a surface of the vaporization core facing away from the air inlet and extends in a direction parallel to the axial direction of the air outlet channel.

9. The vaporizer of claim 1, further comprising:

a magnetic member, wherein the base comprises a bottom wall arranged opposite to the top wall, and wherein the magnetic member is assembled on the bottom wall.

10. An electronic vaporization device, comprising:

the vaporizer of claim 1.

11. The vaporizer of claim 1, wherein the air inlet, the vaporization channel, and the air outlet channel form an airflow pathway.

12. The vaporizer of claim 11, wherein the airflow pathway is L-shaped.

13. The vaporizer of claim 6, wherein an air passing opening in communication with the vaporization channel is provided on the base body.

14. The vaporizer of claim 13, wherein the air passing opening provided on the base body is in communication with the air outlet channel.

15. A vaporizer, comprising:

a housing, an air outlet channel being formed in the housing; and a vaporization assembly assembled in the housing and comprising a base and a vaporization core, the base comprising a base body and a holder, the vaporization core and the holder being inserted in the base body, the holder fixing the vaporization core in the base body, the base body comprising a top wall facing the air outlet channel, and the holder of the base comprising a side wall intersecting with and connected to the top wall of the base body, wherein a vaporization channel in communication with the air outlet channel is defined between the side wall and the vaporization core, the vaporization channel being located in an axial direction of the air outlet channel, wherein the vaporization core comprises a vaporization surface parallel to the axial direction of the air outlet channel, and wherein an air inlet in communication with the vaporization channel is provided on the side wall of the holder that is inserted in the base body, so as to directly face the vaporization surface of the vaporization core.

16. A vaporizer, comprising:

a housing, an air outlet channel being formed in the housing; and a vaporization assembly assembled in the housing and comprising a base and a vaporization core, the base comprising a base body and a holder, the vaporization core and the holder being inserted in the base body, the holder fixing the vaporization core in the base body, the base body comprising a top wall facing the air outlet channel, and the holder of the base comprising a side wall intersecting with and connected to the top wall of the base body, wherein a vaporization channel in communication with the air outlet channel is defined between the side wall of the holder of the base and the vaporization core, the vaporization channel being located in an axial direction of the air outlet channel, wherein the vaporization core comprises a vaporization surface parallel to the axial direction of the air outlet channel, wherein the vaporization assembly further comprises an electrode, a first end of the electrode electrically connected to a heating member on the vaporization core, and a second end of the electrode penetrating through the side wall of the holder, and wherein an air inlet in communication with the vaporization channel is provided on the side wall of the holder of the base, so as to directly face the vaporization surface of the vaporization core.

17. The vaporizer of claim 16, wherein the outer surface of the side wall is spaced apart from an inner wall of the housing to provide a docking cavity.

18. The vaporizer of claim 17, wherein a docking convex portion on a cell base is inserted into the docking cavity so that the electrode of the vaporization assembly is in electrical contact with a docking terminal of the docking convex portion, thereby achieving an electrical connection between the heating member of the vaporization core and the cell base.

19. The vaporizer of claim 18, wherein an air inlet is formed inside the docking convex portion, such that external airflow enters the air inlet after passing through the air inlet channel in the docking convex portion.

* * * * *